US008297985B1

(12) United States Patent
Beller et al.

(10) Patent No.: US 8,297,985 B1
(45) Date of Patent: Oct. 30, 2012

(54) CONNECTOR WITH SURFACE MOUNT SIGNAL PIN

(75) Inventors: Les Beller, Parker, CO (US); Jerome A. LaPalme, Aurora, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 0 days.

(21) Appl. No.: 13/118,206

(22) Filed: May 27, 2011

(51) Int. Cl.
*H01R 12/00* (2006.01)

(52) U.S. Cl. ..... 439/63; 439/581

(58) Field of Classification Search ..... 439/63, 439/581

See application file for complete search history.

(56) References Cited

U.S. PATENT DOCUMENTS

| | | | | |
|---|---|---|---|---|
| 5,046,952 | A * | 9/1991 | Cohen et al. | 439/63 |
| 5,062,809 | A * | 11/1991 | Sakamoto et al. | 439/581 |
| 5,478,258 | A * | 12/1995 | Wang | 439/581 |
| 5,899,754 | A * | 5/1999 | Beloritsky et al. | 439/63 |
| 6,824,392 | B1 * | 11/2004 | Guo | 439/63 |
| 7,118,381 | B2 * | 10/2006 | Weidner | 439/63 |
| 7,150,648 | B1 * | 12/2006 | Hall et al. | 439/581 |
| 7,186,139 | B2 * | 3/2007 | Chen et al. | 439/541.5 |
| 7,491,087 | B2 * | 2/2009 | Swantner et al. | 439/582 |
| 7,946,854 | B2 * | 5/2011 | Weidner et al. | 439/63 |
| 2008/0102654 | A1 * | 5/2008 | Kari | 439/63 |
| 2008/0160793 | A1 * | 7/2008 | Kerekes et al. | 439/63 |
| 2009/0137133 | A1 * | 5/2009 | Gou | 439/63 |
| 2009/0197462 | A1 * | 8/2009 | Chen et al. | 439/541.5 |
| 2009/0220013 | A1 * | 9/2009 | Butts et al. | 375/257 |
| 2010/0176896 | A1 * | 7/2010 | Payne | 333/33 |

* cited by examiner

*Primary Examiner* — Ross Gushi
(74) *Attorney, Agent, or Firm* — Seed IP Law Group PLLC

(57) ABSTRACT

In various embodiments, a coaxial radio frequency (RF) connector has a circuit board surface mount signal pin that forms no sharp angles (and especially no sharp right angles) as it leads down from an axis of the connector to the level of a printed circuit board 44 to which the signal pin 18 is to be surface mounted. The signal pin is flat and has a first section, a second section and a third section. The first section extends axially from the first end of the signal pin housing. The second section is a transition from the first section to the third section and has a filleted interior corner and a corresponding rounded exterior corner providing a gradual transition between a direction in which the first section extends to a different direction in which the third section extends. The third section then forms a downward curve around an axis that is substantially parallel to an axis of the first section.

26 Claims, 8 Drawing Sheets

CONNECTOR WITH SURFACE MOUNT SIGNAL PIN

BACKGROUND

1. Technical Field

The technical field relates to electrical connectors, and more particularly to electrical connectors for cables.

2. Background

Signal integrity, flexibility and resilience of electrical connectors mounted on printed circuit boards is important for the performance of electronic equipment including such connectors.

Shown in FIG. 1 and FIG. 2 is an example of a traditional surface mount radio frequency (RF) coaxial connector 2. The signal pin 4 extends from the connector housing 6 and then angles sharply down to the level of a printed circuit board 8 to which the signal pin 4 is to be surface mounted. Signal integrity and flexibility is compromised by the shape and design of the traditional signal pin 4 shown.

Thus, a surface mount RF coaxial connector is needed that provides improved signal integrity, flexibility and resilience in manufacturing, installation and use of the connector.

BRIEF SUMMARY

In one embodiment, a coaxial RF connector has a circuit board surface mount signal pin that forms no sharp angles (and especially no sharp right angles) as it leads down from an axis of the connector to the level of a printed circuit board 44 to which the signal pin 18 is to be surface mounted. The signal pin has a first section, a second section and a third section. The first section extends axially from the first end of the signal pin housing and the second section is a transition from the first section to the third section. The third section then forms a curve around an axis that is substantially parallel to an axis of the first section.

A receiving device including a printed circuit board and a radio frequency connector as described above conductively affixed to the printed circuit board is provided.

A circuit board surface mount signal pin as described above for a radio frequency connector is also provided.

BRIEF DESCRIPTION OF THE DRAWINGS

Like reference numerals designate corresponding parts throughout the several views.

DETAILED DESCRIPTION

Figure 1:
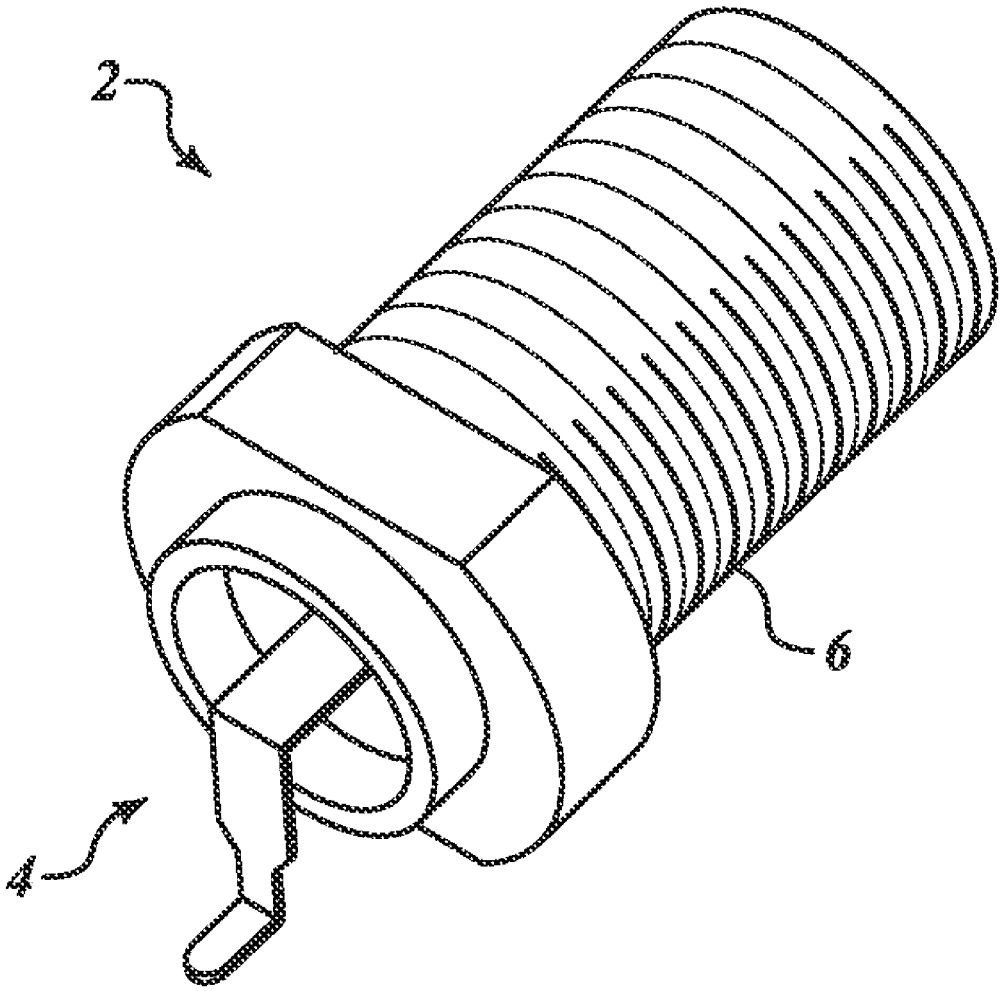
FIG. 1 (Prior Art)
FIG. 1 is a prior art top right perspective view of a connector with a surface mount signal pin.
Figure 2:
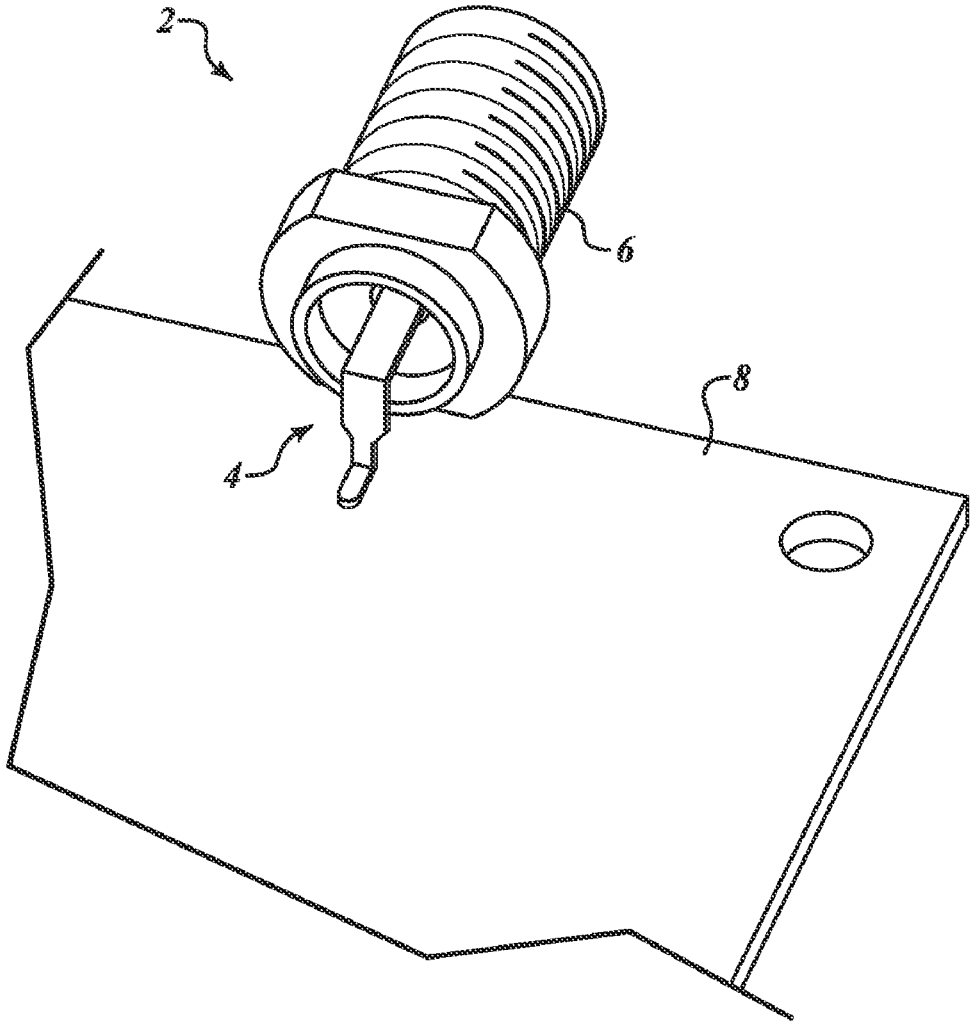
FIG.2 (Prior Art)
FIG. 2 is a prior art top right perspective view of the connector of FIG. 1 surface mounted on a printed circuit board.
Figure 3:
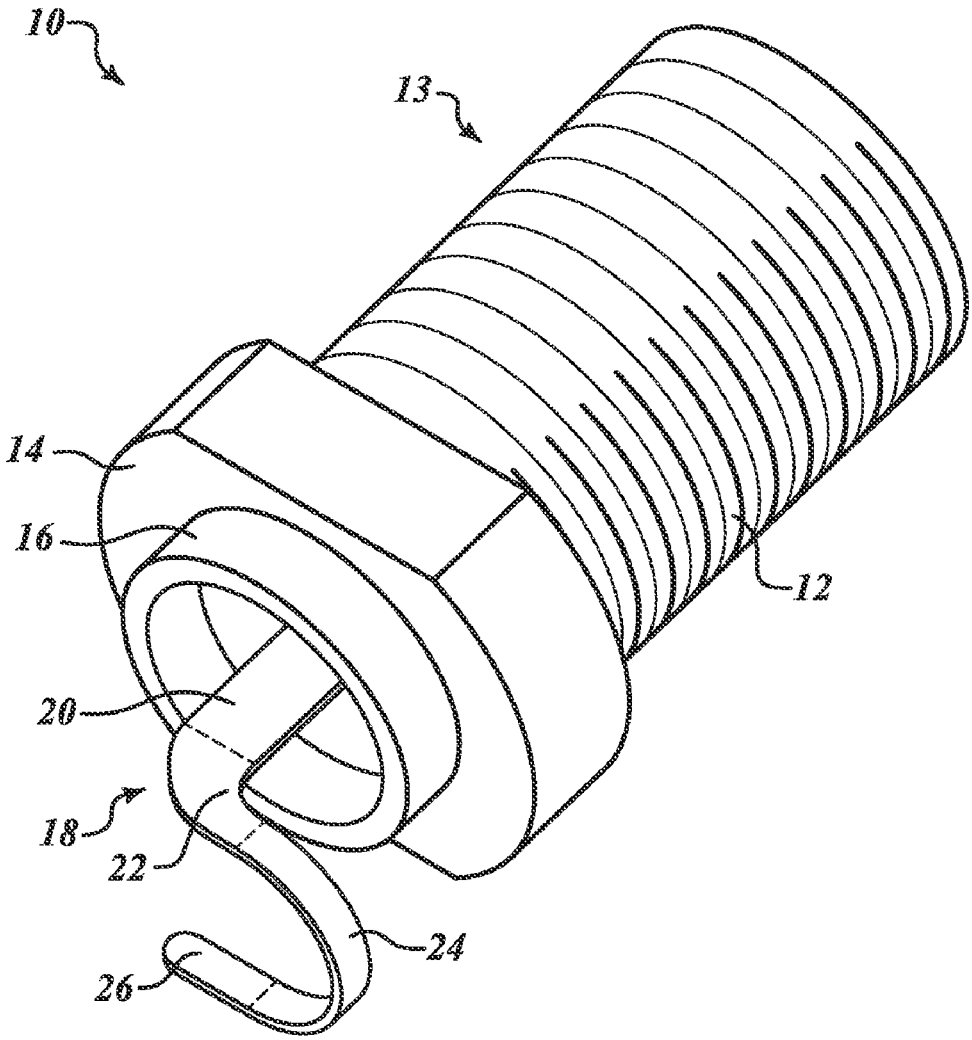
FIG. 3 is a top right perspective view of a connector with a surface mount signal pin according to one example embodiment.

Shown in FIG. 3 is a top right perspective view of a connector 10 with a surface mount signal pin 18 according to one example embodiment. The connector 10 is an electrical connector designed to work at radio frequencies in the multi-megahertz range. For example, the connector 10 may be a coaxial radio frequency (RF) connector configured to operably connect to a coaxial cable. In particular, the coaxial RF connector 10 shown in FIG. 3 is an F connector configured to be surface mounted on a printed circuit board 44 (shown in FIG. 8) at a contact 26 of the signal pin 18. This enables a coaxial cable to be operably connected to the printed circuit board 44 to provide a high speed signal connection to the printed circuit board 44 by operably connecting the coaxial cable at an opposite female or male end of the connector 10. In one embodiment, the connector 10 provides electrical performance at approximately 75 ohms impedance, which may vary in other embodiments according to particular applications, requirements and standards.

The signal pin 18 forms no sharp angles (and especially no sharp right angles) as it leads down to the level of a printed circuit board 44 (shown in FIG. 8) to which the signal pin 18 is to be surface mounted. This improves signal characteristics of the signal pin 18 contact material as compared to signal pins of traditional connectors. The downwardly curved or arched section 24 also improves flexibility and resiliency during manufacturing of the connector 10, during the installation of the connector in devices of which the connector 10 is a part, and also during the connection of an external coaxial cable to the connector 10. For example, torque applied to the connector 10 during installation or during connection of an exterior cable to the connector 10 is better absorbed by the curved or arched section 24 than in traditional connectors.

The connector 10 has a housing 13 including a threaded barrel 12 which has an opening on a proximal end through which the signal pin 18 extends. A shoulder nut 14 may be fixedly or rotatably attached to the proximal end of the threaded barrel 12. The shoulder nut 14 may also have a circular flange or collar 16 surrounding the opening. To provide additional stability and/or RF shielding of the connector 10 when mounted on the printed circuit board 44 (shown in FIG. 8), the shoulder nut 14 and collar 16 assembly may enable the connector 10 to be coupled to an additional bracket or RF shield fence (not shown) to be attached to the printed circuit board 44. For example, the connector 10 may be coupled to the bracket or RF shield fence at a hole in the side of the bracket or RF shield fence through which the collar 16 extends.

The particular configurations and features of the barrel 12, shoulder nut 14 and collar 16 may vary according to the particular applications, uses and environments in which the connector 10 is used. For example, in other embodiments, the barrel 12 may have no threading, or the shoulder nut 14 and/or collar 16 may be omitted. The configurations of the barrel 12, shoulder nut 14 and collar 16 may vary in order to comply with various industry standards, performance requirements and different types of connections, printed circuit boards and brackets with which the connector 10 is to be used.

The signal pin 18 is made of a conductive material. For example, the conductive material may be copper, phosphor bronze, aluminum or any other conductive metal or material. The signal pin 18 has a first section 20, a second section 22 and a third section 24 and is and is operably mounted within the barrel 12. The first section 20 extends axially from the proximal end of the signal pin housing 13 that is surrounded by the collar 16. The second section 22 is a transition from the first section 20 to the third section 24 and the third section 24 is curved or arched in a downward direction. In one embodiment, the first section 20, second section 22 and third section 24 are formed integral with each other. However, in other embodiments, one or more of the sections may be affixed to each other in various conductive manners.

Figure 4:
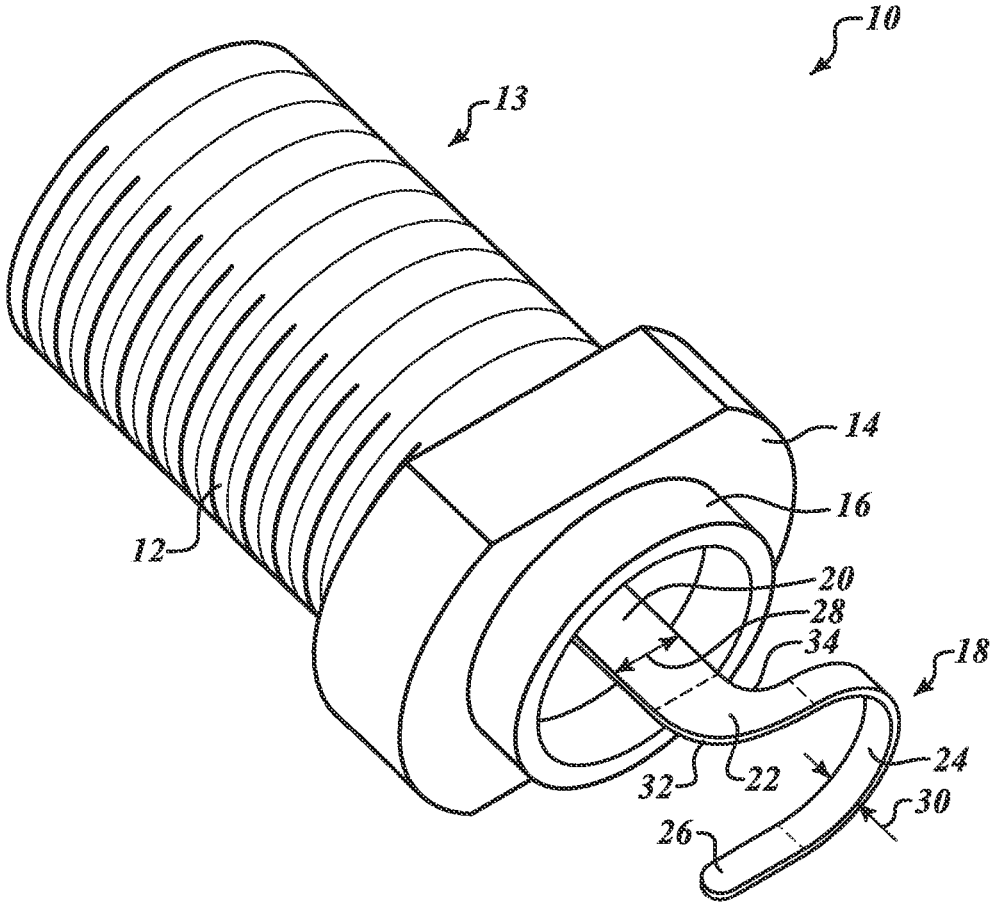
FIG. 4 is a top left perspective view of the connector of FIG. 3 according to one example embodiment.

Referring next to FIG. 4, shown is a top left perspective view of the connector 10 according to one example embodiment. Note the signal pin 18 is flat (i.e., its width is greater than its thickness) and the first section 20 and second section 22 of the signal pin 18 share a common planar surface. The edges of the signal pin extending along the planar surface are straight in the first section 20, but are then curved in the second section 22 to form a filleted interior corner 34 in the second section 22 and a corresponding rounded exterior corner 32 in the second section 22 as a transition between a direction in which the first section 20 extends to a different direction in which the third section 24 extends, thus avoiding forming sharp angles in the second section 22 and providing a gradual transition from the first section 20 to the third section 24.

As shown in FIG. 4, the second section 22 of the signal pin 18 curves laterally in a first direction within the common planar surface of the first section 20 and second section 22. The third section 24 then begins to curve downward in a clockwise direction below the common planar surface of the first section 20 and second section 22. However, in other embodiments the second section 22 of the signal pin 18 may curve laterally in the opposite direction as that shown in FIG. 4 and thus, the third section 24 having the curved or arched shape would instead extend generally downward in a counterclockwise direction.

The width 28 of the signal pin 18 at the first section 20 is larger than the width 30 of the signal pin 18 at the third section 24. Note, however, the width of the signal pin 18 at the second section 22 gradually transitions from the width 28 of the signal pin 18 at the first section 20 to the width 30 of the signal pin 18 at the third section 24 to avoid forming any sharp angles in the transition. In one embodiment, the width 28 of the signal pin 18 at the first section 20 is 2.1 mm and the width 30 of the signal pin at the third section 24 is 1 mm, but these widths may vary in other embodiments according to different particular applications, performance requirements and standards.

The third section 24 has a subsection 26 at the end of the third section 24. The subsection 26 is a contact that has a planar surface substantially parallel to a planar surface of the printed circuit board 44 (shown in FIG. 8) to which the signal pin 18 is to be surface mounted by soldering or otherwise conductively affixed.

Figure 5:
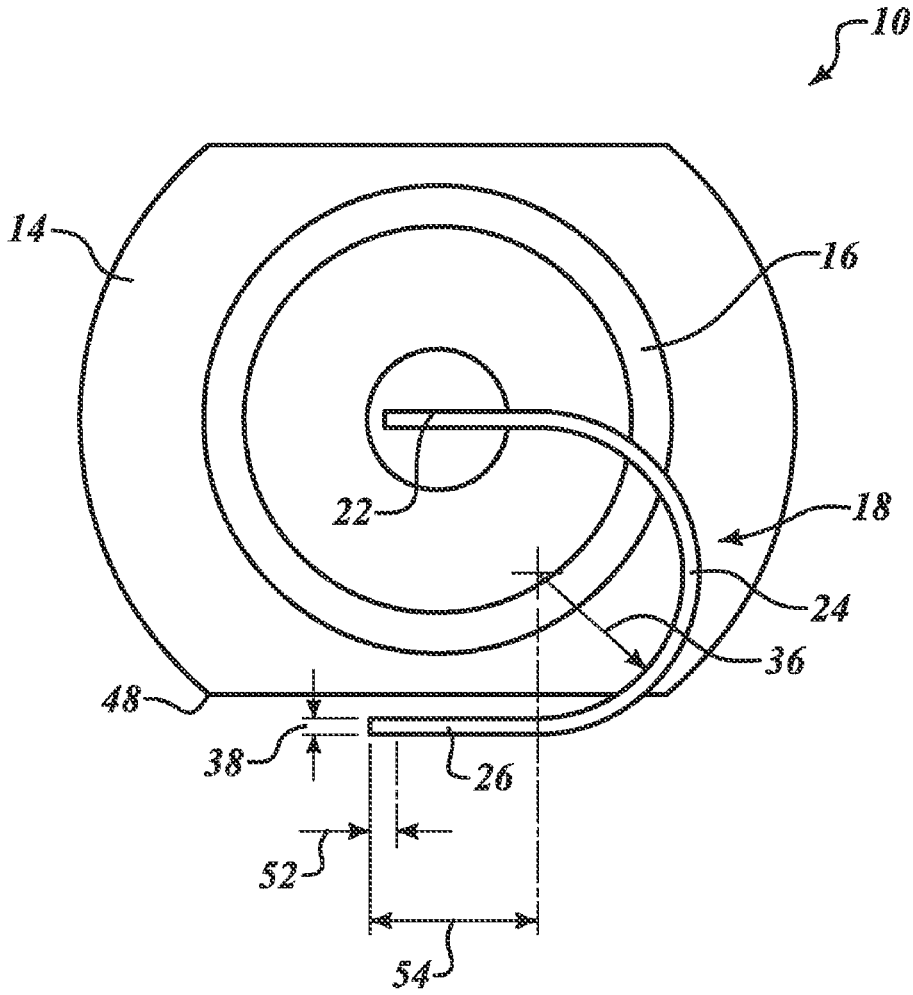
FIG. 5 is a front elevation view of the connector of FIG. 3 according to one example embodiment.

Referring next to FIG. 5, shown is a front elevation view of the connector 10 according to one example embodiment. In FIG. 5, the thickness 38 of the signal pin 18 may be seen clearly. The thickness 38 of the signal pin 18 is substantially the same in each section of the signal pin 18. In one embodiment, the thickness 38 is 0.25 mm, but the thickness 38 may vary in other embodiments according to different particular applications, performance requirements and standards.

In the embodiment shown in FIG. 5, the curved or arched third section 24 has a circular arc with a radius 36 of approximately half the distance between the bottom planar surface of the second section 22 of the signal pin 18 and a top planar surface of the printed circuit board 44 (shown in FIG. 8) on which the connector 10 is to be surface mounted. Thus, the arc radius 36 may vary as a function of the vertical distance between the second section 22 of the signal pin 18 and a top planar surface of the printed circuit board 44 on which the connector 10 is to be surface mounted. For example, a larger distance between the second section 22 of the signal pin 18 and a top planar surface of the printed circuit board 44 would result in a larger radius 36. In other alternative embodiments, the arc of the curved or arched third section 24 may have a parabolic, elliptical or other curved or compound curved shape such that there are also no sharp angles formed in the signal pin 18 as the signal pin 18 leads down to the level of a printed circuit board 44 to which it is to be surface mounted.

Note the signal pin contact 26 has a planar surface substantially parallel to a top planar surface of the printed circuit board 44 and is at a level slightly lower (e.g., 0.25 mm lower) than the lower surface of the shoulder nut 14. However, in other embodiments, the signal pin contact 26 may be at the same level or different level than the lower surface of the shoulder nut 14 so long as some clearance is provided between the printed circuit board 44 to which the connector 10 is to be mounted and the lower surface of the shoulder nut 14 should the printed circuit board 44 extend that far. In one embodiment, the signal pin contact 26 has a tip with a length 52 of 0.5 mm and a total length 54 of 2.8 mm. The signal pin contact 26 is substantially parallel to the top planar surface of the printed circuit board 44. The signal pin contact tip length 52 and total length 54 may both vary in other embodiments according to particular applications, requirements and standards, including, among others, those of particular printed circuit boards or solder pads.

Figure 6:
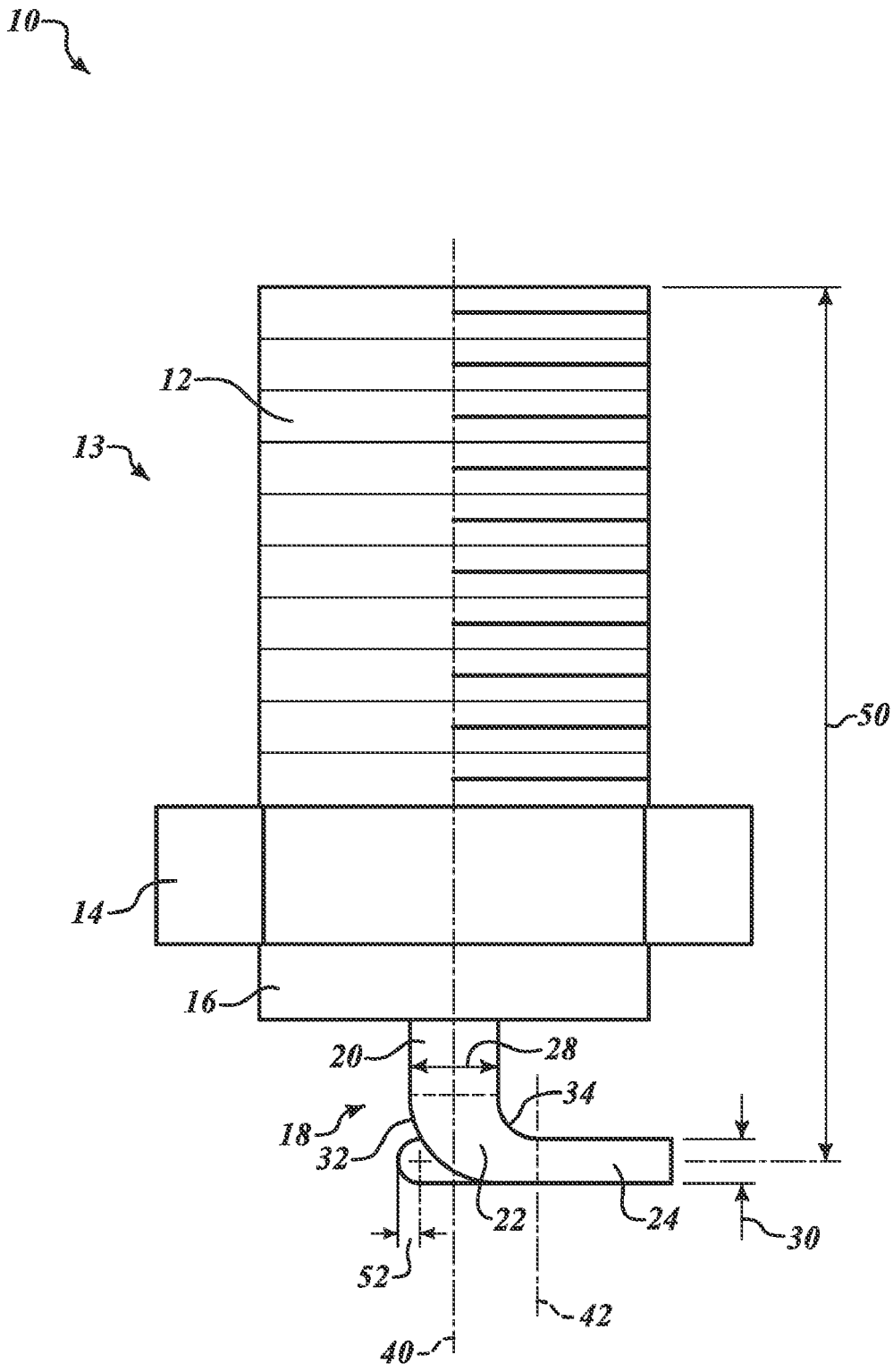
FIG. 6 is a top plan view of the connector of FIG. 3 according to one example embodiment.
Figure 7:
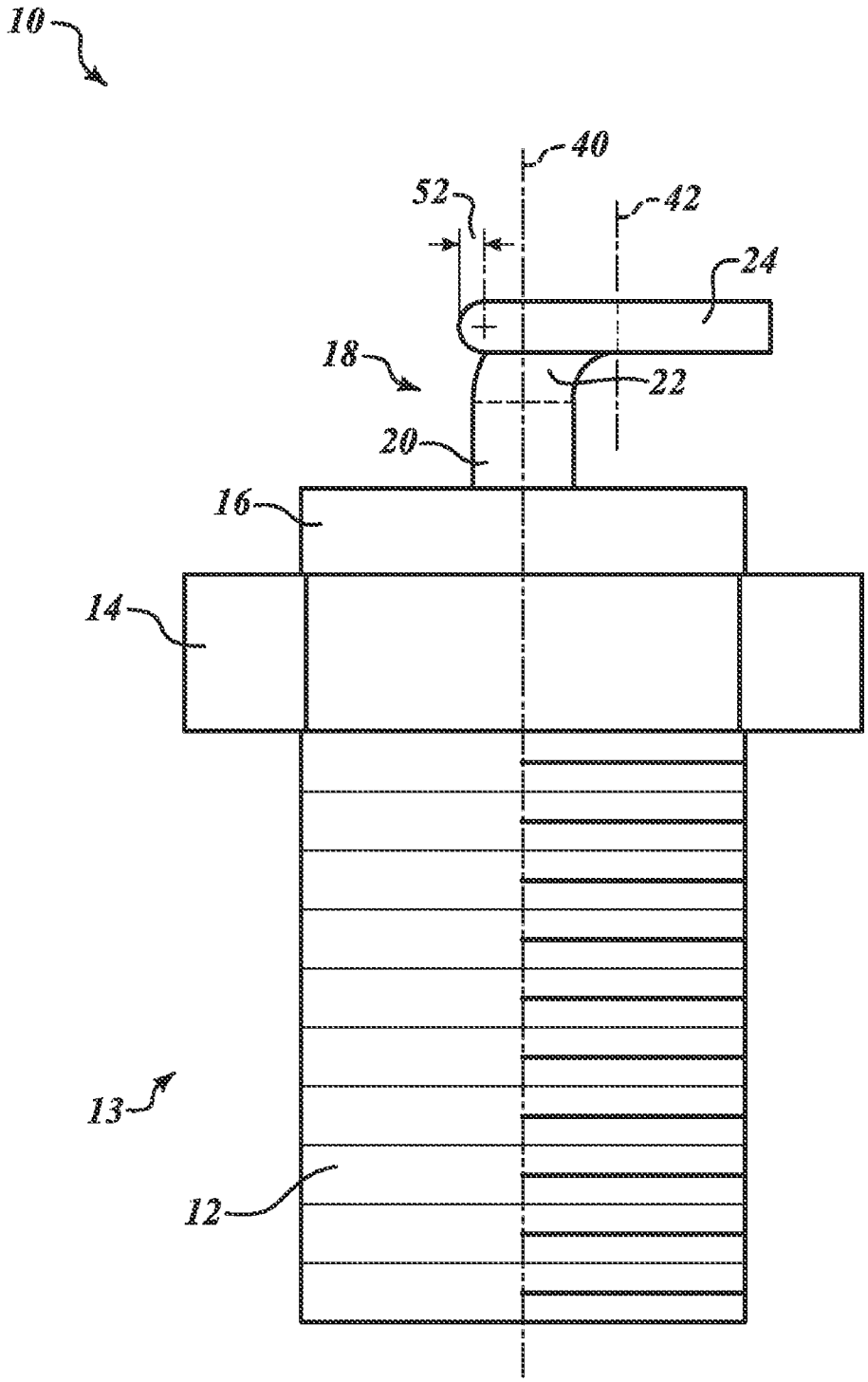
FIG. 7 is a bottom plan view of the connector of FIG. 3 according to one example embodiment.

Referring next to both FIG. 6 and FIG. 7, shown are a top plan view and a bottom plan view, respectively, of the connector 10 according to one example embodiment. As can be seen clearly in FIG. 6, the arc of the filleted interior corner 34 has a radius smaller than the radius of the arc of the rounded exterior corner 34. In one embodiment, the arc of the filleted interior corner 34 has a radius that is equal to or larger than approximately half the width 30 of the curved third section 24 of the signal pin 18 and the arc of the rounded exterior corner 32 has a radius that is equal to or larger than approximately half the width 28 of the first section 20 of the signal pin 18. However, the arc of the filleted interior corner 34 and the arc of the rounded exterior corner 32 may vary in other embodiments to the extent that there are no sharp angles formed in signal pin 18 in the second section 22 providing a gradual transition from the first section 20 to the third section 24.

Also shown is an axis 40 of the connector 10 and a parallel axis 42 around which the third section 24 of the signal pin 18 curves. Parallel axis 42 around which the third section 24 of the signal pin 18 curves is in a different vertical plane than the connector axis 40. In one embodiment the total length 50 of the connector 10 from the distal end of the connector 10 to the centerline of the signal pin 18 is 22.4 mm, but may vary in other embodiments depending on the width 30 of the curved third section 24 of the signal pin 18 and according to particular applications, requirements and standards, including, among others, those of particular printed circuit boards.

In another embodiment, the axis around which the third section 24 of the signal pin 18 curves may be perpendicular to the connector axis 40. In this embodiment, the signal pin 18 extends axially from the housing 13 in both the first section 20 and the second section 22 and then curves downward to the level of a printed circuit board to which the signal pin 18 will be affixed.

Figure 8:
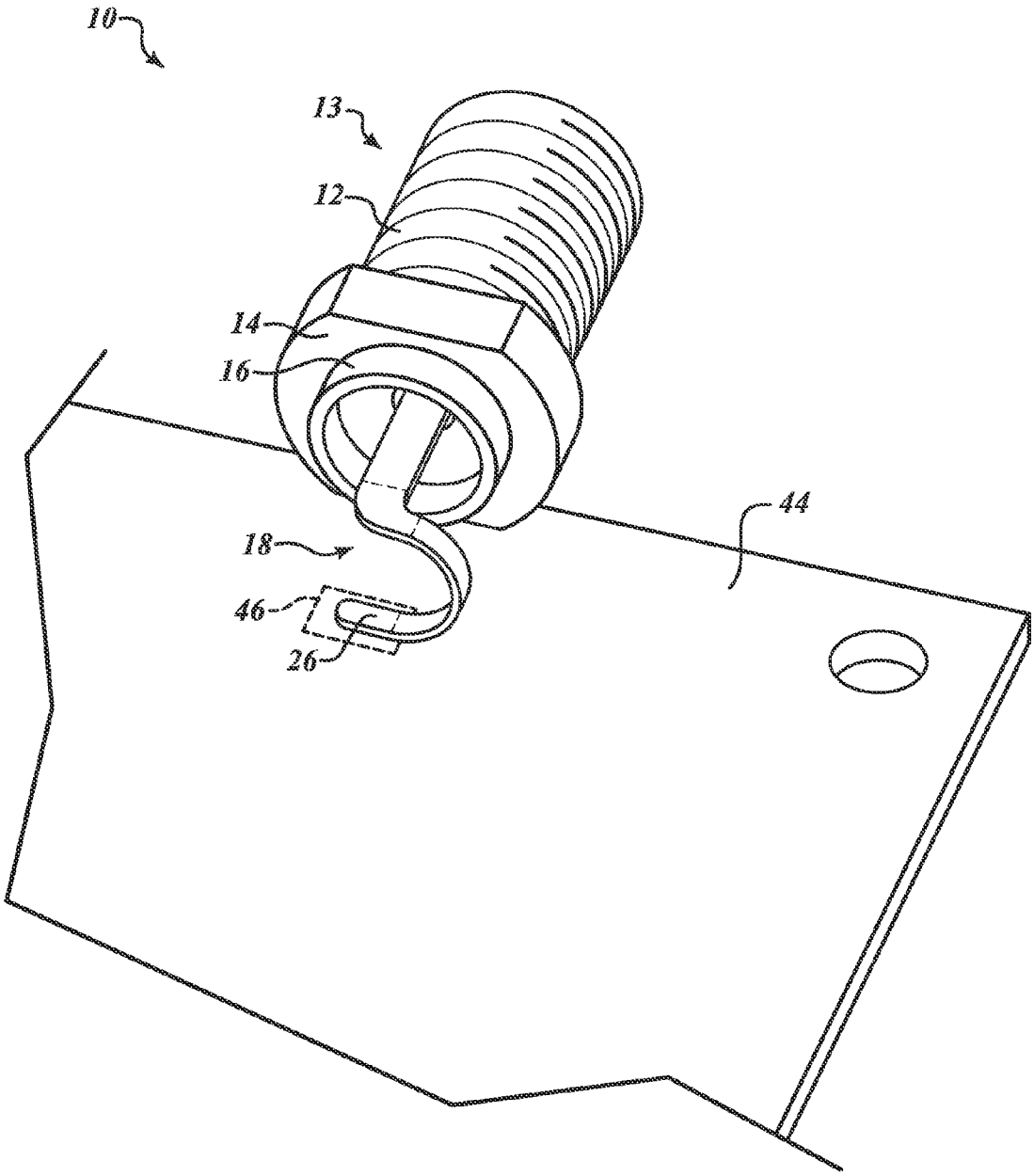
FIG. 8 is a top right perspective view of the connector of FIG. 3 surface mounted on a printed circuit board.

Referring next to FIG. 8, shown is a top right perspective view of the connector 10 surface mounted on a printed circuit board 44. In one embodiment, the connector 10 is conductively and operably affixed to a planar surface of the printed circuit board 44 at solder pad 46. In other alternative embodiments, the connector 10 may be conductively and operably affixed to the printed circuit board 44 in other manners such as by through holes in the printed circuit board 44.

To provide additional stability and/or RF shielding of the connector 10 when mounted on the printed circuit board 44, the shoulder nut 14 and collar 16 assembly may enable the connector 10 to be coupled to an additional bracket or RF shield fence (not shown) to be attached to the printed circuit board 44. For example, the connector 10 may be coupled to the bracket or RF shield fence at a hole in the side of the bracket or RF shield fence through which the collar 16 extends.

An assembly including the connector 10 and printed circuit board 44 may be operably included in various electronic devices and communication devices including, but not limited to receiving devices, set-top boxes, televisions, home electronics, computers, satellite equipment, network equipment and any other device to which a cable may be connected.

While various embodiments have been described hereinabove, it is to be appreciated that various changes in form and detail may be made without departing from the spirit and scope of the invention(s) presently or hereafter claimed.

The invention claimed is:

1. A coaxial radio frequency connector comprising:
a signal pin housing; and
a circuit board surface mount signal pin extending from a first end of the signal pin housing, the signal pin having a first section, a second section and a third section, wherein the first section extends axially from the first end of the signal pin housing, wherein the second section is a transition from the first section to the third section, and wherein the third section forms a curve around an axis that is substantially parallel to a lengthwise axis of the first section.

2. The connector of claim 1 wherein a width of the signal pin is greater than a thickness of the signal pin, the first section and second section sharing a planar surface, and wherein a first edge and a second edge extending along the planar surface are straight in the first section, and the first edge and section edge extending along the planar surface are curved in the second section forming a filleted interior corner in the second section and a corresponding rounded exterior corner in the second section as a transition between a direction in which the first section extends to a different direction in which the third section extends.

3. The connector of claim 2 wherein a width of the signal pin at the first section is larger than a width of the signal pin at the third section.

4. The connector of claim 3 wherein a width of the signal pin at the second section gradually transitions from the width of the signal pin at the first section to the width of the signal pin at the third section.

5. The connector of claim 3 wherein the width of the signal pin at the second section is approximately 2.1 mm and the width of the signal pin at the third section is approximately 1 mm.

6. The connector of claim 2 wherein an arc of the filleted interior corner has a radius that is equal to or larger than approximately half a width of the of the signal pin at the third section.

7. The connector of claim 2 wherein a thickness of the signal pin is approximately 0.25 mm.

8. The connector of claim 2 wherein an arc of the corresponding exterior corner has a radius that is equal to or larger than approximately half a width of the of the signal pin at the first section.

9. The connector of claim 2 wherein an arc of the filleted interior corner has a radius that is smaller than a radius of an arc of the corresponding exterior corner.

10. The connector of claim 2 wherein the connector is an F connector.

11. The connector of claim 2 wherein the third section has a subsection which is a contact that has a planar surface substantially parallel to a planar surface of a printed circuit board on which the signal pin is to be mounted.

12. The connector of claim 2 wherein the subsection is configured to be conductively affixed to a solder pad of the printed circuit board.

13. The connector of claim 12 wherein the subsection is at a level equal to or below a level of a lower surface of the signal pin housing.

14. The connector of claim 2 wherein the curve has a semicircular shape.

15. A receiving device comprising:
a printed circuit board; and
a radio frequency connector conductively affixed to the printed circuit board, the radio frequency connector including:
a signal pin housing; and
a circuit board surface mount signal pin extending from a first end of the signal pin housing, the signal pin having a first section, a second section and a third section, wherein the first section extends axially from the first end of the signal pin housing, wherein the second section is a transition from the first section to the third section, and wherein the third section forms a curve around an axis that is substantially parallel to a lengthwise axis of the first section, the radio frequency connector conductively affixed to the printed circuit board at an end of the third section.

16. The receiving device of claim 15 wherein a width of the signal pin is greater than a thickness of the signal pin, the first section and second section sharing a planar surface, and wherein a first edge and a second edge extending along the planar surface are straight in the first section, and the first edge and section edge extending along the planar surface are curved in the second section forming a filleted interior corner in the second section and a corresponding rounded exterior corner in the second section as a transition between a direction in which the first section extends to a different direction in which the third section extends.

17. The receiving device of claim 16 wherein a width of the signal pin at the first section is larger than a width of the signal pin at the third section.

18. The receiving device of claim 17 wherein a width of the signal pin at the second section gradually transitions from the width of the signal pin at the first section to the width of the signal pin at the third section.

19. A circuit board surface mount signal pin for a radio frequency connector comprising:
a first section;
a second section formed integral with the first section;
and a third section formed integral with the second section, wherein the first section extends straight along an axis, wherein the second section is a transition from the first section to the third section, and wherein the third section forms a curve around an axis that is substantially parallel to the axis of the first section.

20. The signal pin of claim 19 wherein a width of the signal pin is greater than a thickness of the signal pin, the first section and second section sharing a planar surface, and wherein a first edge and a second edge extending along the planar surface are straight in the first section, and the first edge and section edge extending along the planar surface are curved in the second section forming a filleted interior corner in the second section and a corresponding rounded exterior corner in the second section as a transition between a direction in which the first section extends to a different direction in which the third section extends.

21. The signal pin of claim 20 wherein a width of the signal pin at the first section is larger than a width of the signal pin at the third section.

22. The signal pin of claim 20 wherein the third section has a subsection that has a planar surface substantially parallel to a planar surface of a printed circuit board on which the signal pin is to be mounted and wherein the subsection is configured to be conductively affixed to a solder pad of a printed circuit board.

23. A coaxial radio frequency connector comprising:

a signal pin housing; and a circuit board surface mount signal pin extending from a first end of the signal pin housing, the signal pin having a first section and a second section, wherein the first section extends axially from the first end of the signal pin housing, and wherein the second section forms a curve around an axis that is substantially perpendicular to a lengthwise axis of the first section.

24. The connector of claim 23 wherein the second section has a subsection at the end of the second section which is a contact that has a planar surface substantially parallel to a planar surface of a printed circuit board on which the signal pin is to be mounted.

25. The connector of claim 23 wherein the subsection is configured to be conductively affixed to a solder pad of the printed circuit board.

26. The connector of claim 23 wherein the subsection is at a level equal to or below a level of a lower surface of the signal pin housing.

* * * * *